US006546996B2

(12) United States Patent
Hudson et al.

(10) Patent No.: US 6,546,996 B2
(45) Date of Patent: Apr. 15, 2003

(54) OIL COOLER

(75) Inventors: Scott A. Hudson, Cedar Falls, IA (US); Gerald Werner, Edingen-Neckarhausen (DE)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/107,575

(22) Filed: Mar. 27, 2002

(65) Prior Publication Data

US 2003/0006023 A1 Jan. 9, 2003

(30) Foreign Application Priority Data

Jul. 3, 2001 (DE) ..... 101 32 120

(51) Int. Cl.[7] ..... F28F 3/08; F28F 9/00; F28D 9/00; F28D 1/03; F01P 11/08

(52) U.S. Cl. ..... 165/51; 165/125; 165/167; 165/916; 165/41

(58) Field of Search ..... 165/51, 916, 125, 165/167, 166, 41; 123/196 AB; 184/104.1, 104.3

(56) References Cited

U.S. PATENT DOCUMENTS

| | | | | | |
|---|---|---|---|---|---|
| 1,916,768 | A | * | 7/1933 | Melcher | 165/167 |
| 2,348,020 | A | * | 5/1944 | Norris | 165/167 |
| 2,354,698 | A | * | 8/1944 | Norris | 165/125 |
| 3,743,011 | A | * | 7/1973 | Frost | 165/916 |
| 4,260,015 | A | * | 4/1981 | Tamburini | 165/167 |
| 4,345,644 | A | * | 8/1982 | Dankowski | 165/916 |
| 4,708,199 | A | * | 11/1987 | Yogo et al. | 165/167 |
| 4,793,302 | A | | 12/1988 | Osborne et al. | 123/196 |
| 4,909,311 | A | | 3/1990 | Nakamura et al. | 165/41 |
| 5,078,209 | A | * | 1/1992 | Kerkman et al. | 165/167 |
| 5,172,752 | A | | 12/1992 | Goetz, Jr. | 165/41 |
| 5,445,218 | A | | 8/1995 | Nieh | 165/125 |
| 5,927,394 | A | | 7/1999 | Mendler et al. | 165/166 |
| 6,105,664 | A | * | 8/2000 | Gillbrand et al. | 165/916 |
| 6,182,748 | B1 | * | 2/2001 | Brost et al. | 165/167 |
| 6,263,962 | B1 | * | 7/2001 | Komoda et al. | 165/167 |

FOREIGN PATENT DOCUMENTS

| | | | | |
|---|---|---|---|---|
| DE | 39 38 253 A1 | | 5/1991 | |
| DE | 40 23 042 A1 | | 1/1992 | |
| DE | 41 25 222 A1 | | 2/1992 | |
| DE | 43 32 619 A1 | | 3/1994 | |
| DE | 691 03 044 T2 | | 11/1994 | |
| DE | 197 11 259 A1 | | 10/1998 | |
| DE | 198 02 012 A1 | | 7/1999 | |
| DE | 198 57 511 A1 | | 7/1999 | |
| EP | 0 654 646 B1 | | 5/1995 | |
| GB | 685373 | * | 1/1953 | 165/125 |
| GB | 2 362 208 A | | 11/2001 | |
| JP | 61-128092 | * | 6/1986 | 165/916 |
| JP | 64-8063 | * | 1/1989 | |
| JP | 4-254195 | * | 9/1992 | |
| JP | 6-147787 | * | 5/1994 | 165/916 |
| JP | 11-337692 | * | 12/1999 | |

* cited by examiner

*Primary Examiner*—John K. Ford

(57) ABSTRACT

An oil cooler for an internal combustion engine includes an oil circuit and a cooling circuit arranged in a housing with inlet opening and outlet openings. The housing has a generally annular, C-shaped structure which forms a central, axial cylindrical bore and a radially extending slot. The housing is attached to an annular plate. The bore may receive engine components, such as shafts and the like.

10 Claims, 1 Drawing Sheet

10
12
14
16
18
20
22
24
26
28
A
B
a

OIL COOLER

FIELD OF THE INVENTION

This invention relates to an oil cooler for internal combustion engines, with an oil circuit arranged in a housing with an oil inlet opening and an oil outlet opening, and with a cooling circuit.

BACKGROUND OF THE INVENTION

Oil coolers customarily comprise a substantially parallelepiped housing having inlet and outlet conduits for the oil to be cooled, and inlet and outlet conduits for the coolant. Such an oil cooler with a stacked-disk construction is described in U.S. Pat. No. 5,927,394, and includes of several trough-like plates that are stacked together at intervals and soldered so that their upright edges form adjacent hollow chambers.

An oil cooler can be fastened to a side of an engine block (such as shown in U.S. Pat. No. 4,793,302), or it can be fastened to a component of the vehicle body (such as shown in published German patent DE 40 23 042 A1). But, space for the housing of an oil cooler is limited in the engine area. Moreover, a structure which improves heat exchange between the oil to be cooled and the liquid coolant is also desired.

SUMMARY OF THE INVENTION

An object of the present invention is to provide an oil cooler which has a size and structure so that it can be mounted in places previously unsuitable.

Another object of the present invention is to provide such an oil cooler which has improved heat exchange between the oil to be cooled and the liquid coolant.

This and other objects are achieved by the present invention wherein an oil cooler has an oil circuit and a cooling circuit arranged in a housing with inlet and outlets. The housing has a flat, C-shaped annular shape with an axial thickness which is substantially less than its outer diameter. A bore extends axially through the entire thickness of a central portion of the housing. Engine components, such as a shaft, may extend entirely or partially into the bore.

The oil cooler preferably has a small axial thickness so that it can be mounted in a relatively narrow gap between an engine and the transmission without taking up additional structural space in the constricted engine area. The oil cooler can have relatively large radial dimensions to accommodate long cooling conduits and to have a good heat exchange.

DETAILED DESCRIPTION

Figures 1, 2:
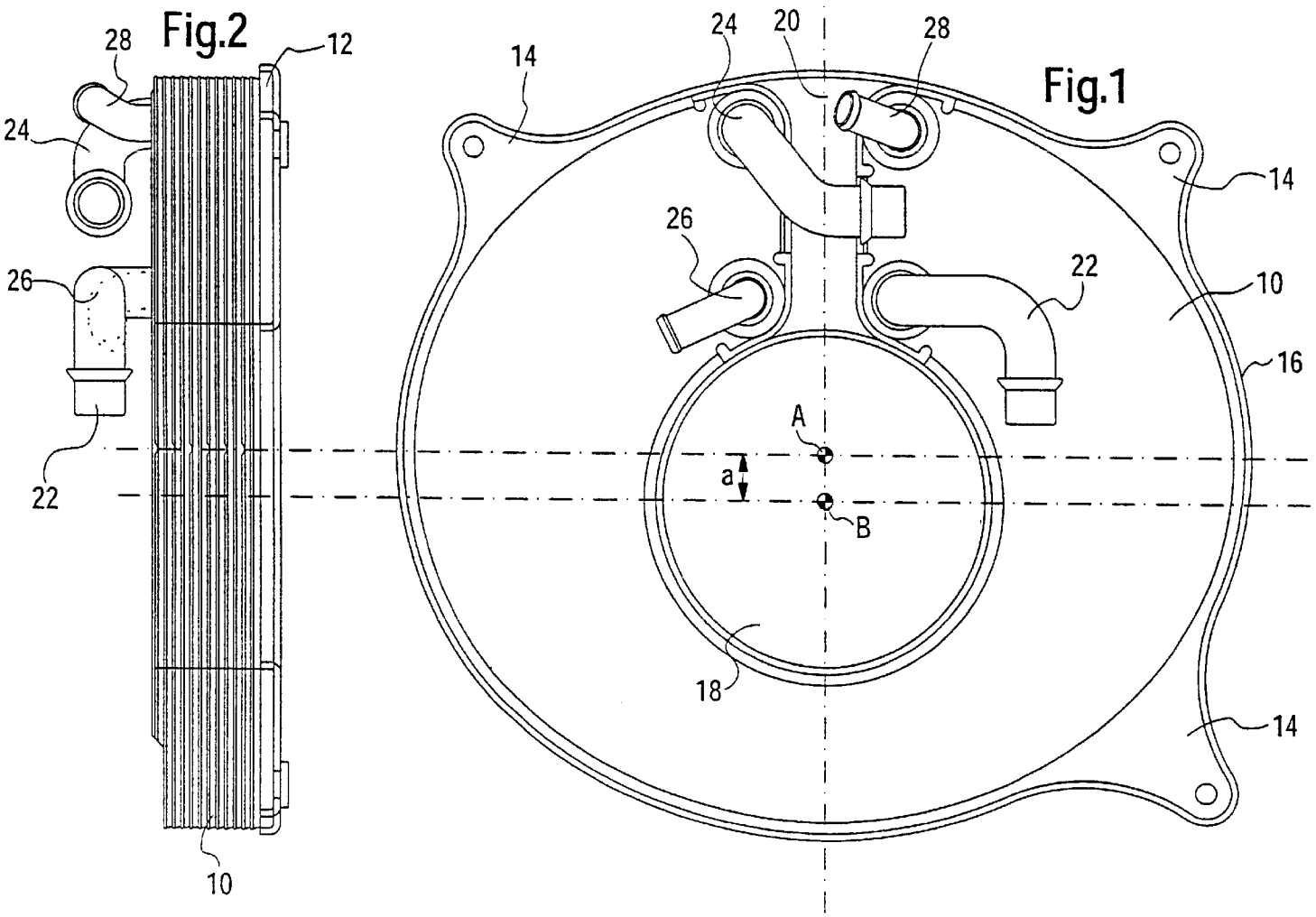
FIG. 1 is a top view of an oil cooler according to the present invention.
FIG. 2 is a side view of the oil cooler of FIG. 1.

As seen in FIGS. 1 and 2, an oil cooler includes a cooler housing 10 fastened on an annular base plate 12. Cooler housing 10 encloses a heat exchanger designed with a known plate structure in which the circumferential housing wall is formed by the upright edges of trough-like plates that are stacked in each other at intervals and soldered. The housing preferably includes a heat exchanger (not shown) formed with plates. The outer wall 16 of the housing is formed by the upright edges of the nested, tub-shaped plates that are stacked at intervals and soldered. The base plate 12 keeps fastening stresses away from the housing 10.

The housing 10 has a generally annular, C-shaped structure which forms a central, axial cylindrical bore 18 and a radially extending slot 20. Plate 12 has three fastening flaps 14 with bores for fasten the plate 12 to a structural component in the engine area of a motor vehicle.

The outer peripheral surface 16 of the housing 10 and of base plate 12 is cylindrical about axis A. Bore 18 extends through the oil cooler 10 and has a central axis B. Axes A and B are spaced apart from each other by distance a. As a result, the radial width of housing 10 varies from a maximum radial width above bore 18 to a minimum radial width below bore 18. The diameter of bore 18 is on the same order of magnitude and somewhat larger, but not more than 3 times the radial width of the annular housing 10.

Preferably, the diameter of outer jacket 16 is between 4 and 12 times greater than the axial thickness of the housing 10.

The slot 20 is positioned where the housing would have its greatest radial width, and the slot extends through the entire thickness of cooler housing 10 between bore 18 and outer jacket 16. The width of slot 20 is smaller than the diameter of bore 18. The slot 20 is also aligned with a line connecting axis A and axis B.

Oil inlet 22, oil outlet 24, coolant inlet 26 and coolant outlet 28 for the oil circuit (not shown) and for the coolant circuit (not shown) are located on the side of the housing 10 opposite plate 12. The inlets and outlets are positioned near to the slot 20 to maximize the length of the oil and coolant passages (not shown) which extend substantially concentrically inside the housing 10. Each connection is provided with an associated hose connection piece to which a corresponding oil or coolant hose (not shown) can be connected. The bore 18 is capable of receiving engine components, such as shafts and the like.

This oil cooler may be arranged between an internal combustion engine (not shown) and a unit such as a transmission (not shown) connected to the engine. The drive shaft (not shown) may extend through the bore 18 of the oil cooler. The oil cooler can thus be placed in an especially favorable location that is not taken up by other structural elements.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

What is claimed is:

1. An oil cooler for an internal combustion engine, the cooler having an oil circuit, an oil inlet opening, an oil outlet opening and a cooling circuit through which a coolant flows, wherein:

the cooler has an annular housing having a bore extending through a central portion thereof, the housing having a cylindrical outer peripheral surface, and the housing having a radial width which varies from a maximum radial width to a minimum radial width; and the housing forming a slot which extends radially therethrough from the bore to the outer peripheral surface of the housing, the slot being aligned with a line connecting the axis of the cylindrical outer peripheral surface of the housing and the central axis of the bore, and the slot extending through the maximum radial width of the housing.

2. The oil cooler of claim 1, wherein:

the housing is attached to a base plate, the bore extending through the housing and the base plate.

3. The oil cooler of claim 1, wherein:

the bore is cylindrical.

4. The oil cooler of claim 2, wherein:

the housing and the base plate have an annular shape with a cylindrical outer peripheral surface and the bore is cylindrical.

5. The oil cooler of claim 4, wherein:

the bore has a diameter which is similar to a radial width of the housing.

6. The oil cooler of claim 1, wherein:

the cylindrical outer peripheral surface of the housing has a central axis which is spaced apart from a central axis of the bore.

7. The oil cooler of claim 1, wherein:

the slot has a width which is substantially less than a diameter of the bore.

8. The oil cooler of claim 1, wherein:

the inlet and outlet openings are arranged on opposite sides of the slot and on a same side of the housing.

9. The oil cooler of claim 1, wherein:

the housing has an outer diameter and an axial thickness, said outer diameter being between 4 and 12 times greater than the axial thickness.

10. An oil cooler for an internal combustion engine, the cooler having an oil circuit, an oil inlet opening, an oil outlet opening and a cooling circuit through which a coolant flows, wherein:

the cooler has an annular housing having a bore extending through a central portion thereof, the housing having a cylindrical outer peripheral surface, and the housing having a radial width which varies from a maximum radial width a minimum radial width;

the housing is attached to a base plate, the bore extending through the housing and the base plate; and the housing forming a slot which extends radially therethrough from the bore to the outer peripheral surface of the housing, the slot being aligned with a line connecting the axis of the cylindrical outer peripheral surface of the housing and the central axis of the bore, and the slot extending through the maximum radial width of the housing.

* * * * *